US005642923A

United States Patent [19]

Meacham et al.

[11] Patent Number: 5,642,923

[45] Date of Patent: Jul. 1, 1997

[54] REMOVABLE SHELF SYSTEM FOR A TRANSPORT CONTAINER

[75] Inventors: Patrick E. Meacham, Lakeville; Mark W. Wallace, Minneapolis; Carl R. Nyberg, Bloomington, all of Minn.; William W. Thompson, Midlothian, Va.; James P. Bland, Chesterfield, Mo.

[73] Assignee: Temp Top Container Systems, Inc., Edina, Minn.

[21] Appl. No.: 546,105

[22] Filed: Oct. 20, 1995

[51] Int. Cl.[6] ..... A47B 43/00

[52] U.S. Cl. ..... 312/258; 312/263; 108/90; 108/106

[58] Field of Search ..... 312/257.1, 258, 312/263, 265.5, 265.6, 108, 351; 108/24, 64, 90, 106

[56] References Cited

U.S. PATENT DOCUMENTS

| | | | |
|---|---|---|---|
| 1,015,430 | 1/1912 | Farmer | 312/258 |
| 3,550,978 | 12/1970 | Magee | 312/108 |
| 4,095,769 | 6/1978 | Fengels | 108/64 |
| 4,215,488 | 8/1980 | Donahedian | 108/24 |
| 4,502,741 | 3/1985 | De Vries et al. | 312/108 |
| 4,785,945 | 11/1988 | Rowse et al. | 108/64 |
| 5,259,608 | 11/1993 | Teufel et al. | 312/265.5 |

*Primary Examiner*—Peter M. Cuomo
*Assistant Examiner*—Gerald A. Anderson
*Attorney, Agent, or Firm*—Kinney & Lange, P.A.

[57] ABSTRACT

The present invention relates to a removable shelf system for a transport container. The removable shelf system includes shelves supported between opposed shelf supports. The shelf supports are supported in an upright position within an inner cavity of the container. The shelves may be removably supported relative to the shelf supports so that the shelves may be removed from the container when not in use or alternatively may be pivotally supported relative to the shelf supports so that the shelf system may be collapsed for storage.

20 Claims, 5 Drawing Sheets

REMOVABLE SHELF SYSTEM FOR A TRANSPORT CONTAINER

BACKGROUND OF THE INVENTION

The present invention relates a removable shelf system for a transport container. More particularly, this invention relates to a removable shelf system for use in storing content in an inner cavity of a transport container. Transport containers are used to ship goods from one location to another. Depending on the content shipped, it is desirable to store the content on individual shelves within the inner .cavity of the container. Depending upon the application, different arrangements of shelves are desirable. Also, it is desirable to remove shelves for other shipping applications as well as when the container is emptied.

SUMMARY OF THE INVENTION

The present invention relates to a removable shelf system for transport container. The removable shelf system includes shelves which are supported by opposed removable shelf supports. Preferably, the shelf supports includes grooves and the shelves include lips which slidably fit within said grooves for removably supporting the shelves. Alternatively, the shelves may be hingedly connected relative to shelf supports to pivot between an upright operational position and a collapsed position. Preferably the shelf supports are separately formed from the transport container for removal during non-use.

DETAILED DESCRIPTION OF THE PREFERRED EMBODIMENTS

Figure 1:
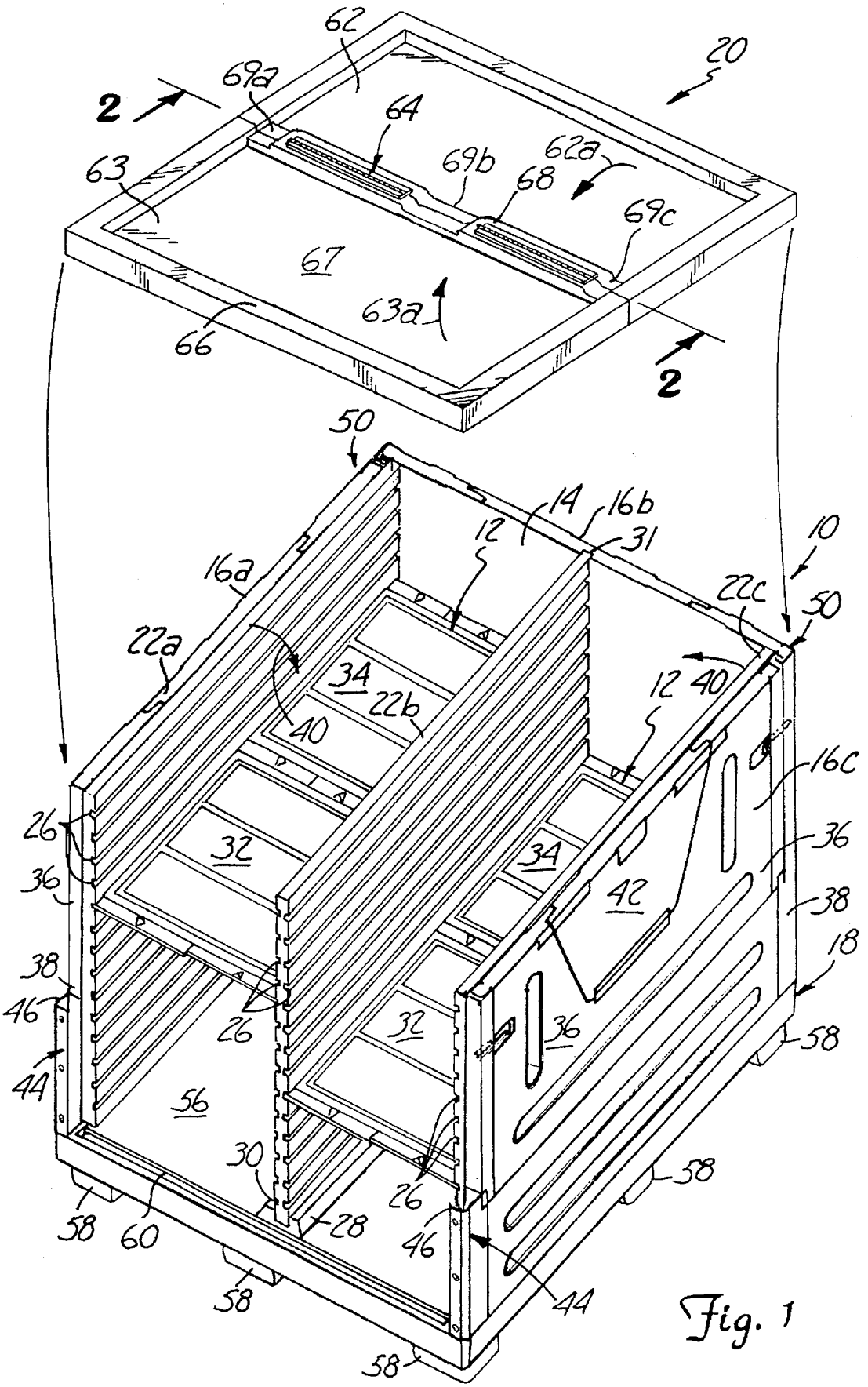
FIG. 1 is a perspective view of a transport container with the cover shown detached and front side wall removed to illustrate the removable shelves of the present invention.

FIG. 1 illustrates a transport container 10 having a plurality of removable shelves 12 which are supported within an inner cavity 14 of the container 10 for supporting goods for transport and storage. The transport container 10 includes four side walls (16*a*, 16*b*, 16*c* and 16*d*), base 18 and cover 20 (shown exploded from the container 10 to illustrate the inner cavity 14). Side wall 16*d* is removed in FIG. 1 to illustrate shelves 12. The side walls (16*a*–16*d*) are perpendicularly connected and extend from the base 18 to form the inner cavity 14 of the container 10.

The shelves 12 are supported between shelf supports 22. Shelf supports 22*a* and 22*c* are aligned with opposed side walls 16*a* and 16*c* of the container 10. The shelf supports 22*a* & 22*c* may be integrally formed with the side walls 16*a* and 16*c* of the container 10. Alternatively, the shelf supports 22*a* & 22*c* may be separately formed and detachably connected relative to opposed side wall 16*a* and 16*c* for use. The shelf supports 22*a* and 22*c* may be detachably connected to side walls 16 and 16*c* via hook and loop attachments. Shelf support 22*b* is supported in the inner cavity 14 of the container 10 between shelf supports 22*a* and 22*c*. The shelf supports 22*a*–22*c* include a plurality of spaced rows of essentially parallel grooves 26 extending along the length thereof. Shelf support 22*b* includes grooves 26 on both sides thereof.

The shelf support 22*b* is supported relative to the base 18 of the container by an elongated stand 28 having an elongated channel 30. The width of the channel 30 corresponds to the width of the shelf support 22*b* such that the shelf support 22*b* snugly fits into channel 30 to support the shelf support 22*b* in an upright position. The elongated stand 28 may be recessed in a channel (not shown) integrally formed in the base 18 of the container 10. As shown, a groove 31 may be formed in side walls 16*b* and 16*d* to provide upright support for the shelf support 22*b*.

Individual shelves 12 are supported between aligned grooves 26 between shelf supports 22*a* & 22*b* and 22*b* & 22*c*. Multiple rows of shelves 12 may be arranged depending upon the cargo along the height of the container 10 via the plurality of rows of grooves 26. Preferably, the shelves 12 are formed of first and second interlocking shelf portions 32 and 34 for ease of removing shelves 12 and to provide structural integrity.

The side walls 16 are formed of upper and lower panels 36 and 38, which are hingedly connected for collapsibility as indicated by arrow 40. The side walls 16 may also include side access gates 42. The lower panels 38 of the side walls 16 are supported relative to the base 18 by corner supports 44 which are fixedly secured to the base 18. The comer supports 44 include perpendicularly aligned comer support channels 46 and 48 (not shown). The edges of lower panels 38 of adjacent side walls (16*a* and 16*b*; 16*b* and 16*c*; 16*c* and 16*d* and 16*d* and 16*a*) are slidably supported within the corner support channels 46 and 48 in perpendicular alignment. Accordingly, the lower panels 38 may be slidably removed (side walls 16*b* and 16*d* (shown removed in FIG. 1)) for access to the shelves 12 of the inner cavity 14 of the container 10. Adjacent upper panels 36 are detachably connected by cooperating coupling members 50 as described. in more detail herein. Adjacent upper panels 36 are detached prior to slidably removing a lower panel 38 for access to the inner cavity 14 of the container 10.

The base 18 of the container 10 includes a platform 56 and legs 58 extending downwardly therefrom. The legs 58 are positioned to allow the tines of a forklift to be inserted under the base 18 for lifting and moving the container 10. The platform 56 includes wall channels 60 (shown with respect to removed side wall 16*d*) for removably supporting the base of the side walls 16 relative to the base 18 of the container 10.

The cover 20 closes the inner cavity 14 of the container 10. The cover 20 includes first and second hinged portions 62 and 63, hinge 64 a raised outer rim 66, a recessed central portion 67 and a raised center ridge 68 having leg recesses 69*a*–69*c*. The first and second hinged portions 62 and 63 allow selective access to each half of the container for removing a side wall 16*b* or 16*d* for access to the shelves 12 within the inner cavity 14 of the container 10. For example, it is necessary that the second hinged portion 63 be opened as indicated by arrow 63*a* so that side wall 16*d* may be removed. Alternatively, the first hinged portion 62 can be opened as indicated by arrow 62*a* so that side wall 16*b* can be removed.

Figure 2:
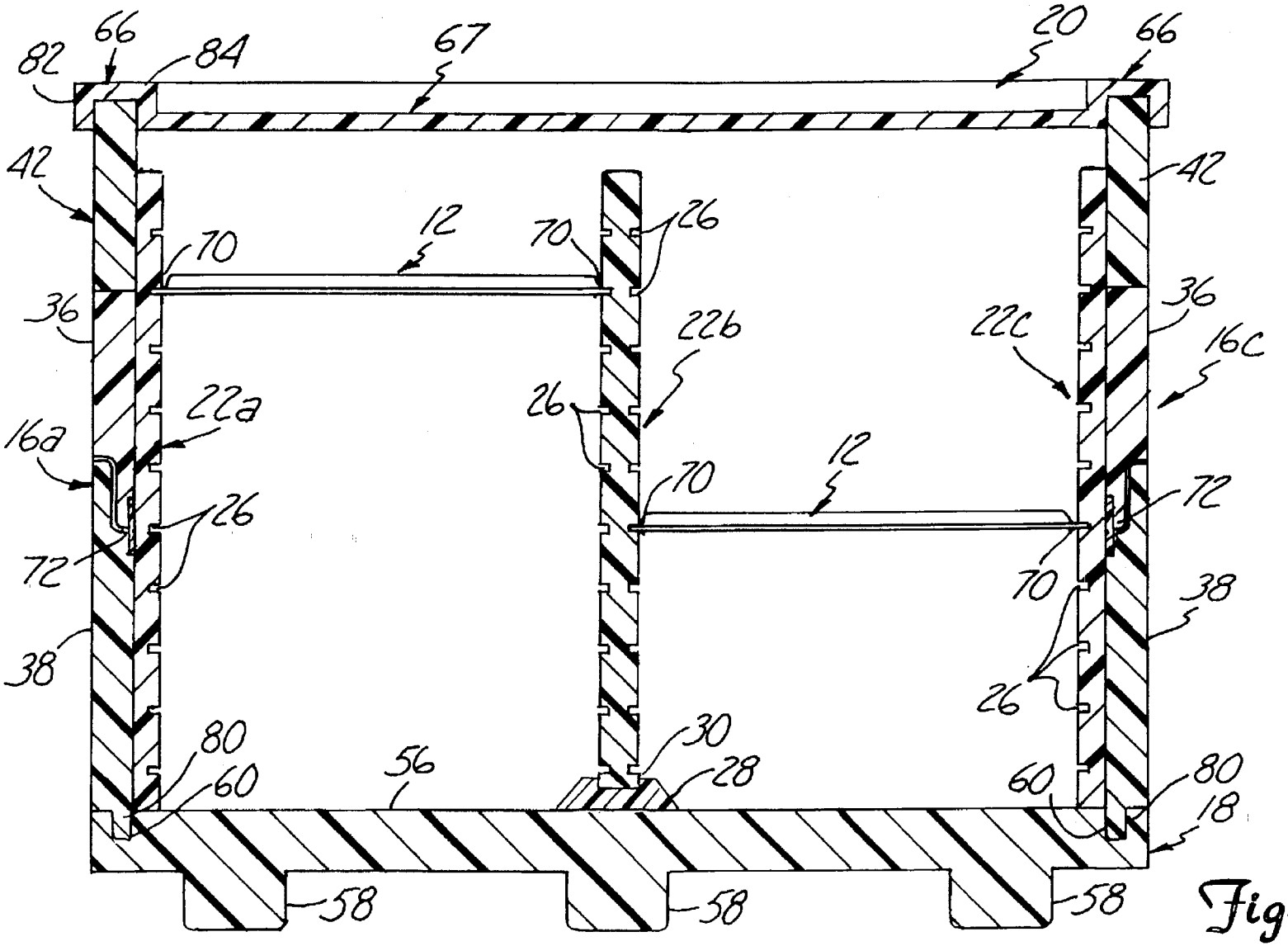
FIG. 2 is a cross-sectional view of a transport container, taken along line 2—2 of FIG. 1, illustrating the removable shelves of the present invention.

FIG. 2 is a cross-sectional view of the container 10. The shelves 12 include lips 70 which extend along opposed sides of the shelves 12. The lips 70 are sized for insertion into the grooves 26 of the shelf supports 22*a*–22*c*. The lips 70 on opposed sides of the shelves 12 are slid into grooves 26 so that the lips 70 are supported within the grooves 26 of the shelf supports 22*a*–22*c* to support the shelves 12. The width of the shelves 12 between sides extends between shelf support 22*a* & 22*b* and/or 22*b* & 22*c*.

As shown in FIG. 2, the upper and lower panels 36 and 38 of the side walls 16 are hingedly connected via cooperation of an elongated flexible plastic hinge 72 extending along the length of the side wall 16. The lower panels 38 of side walls 16*a*–16*d* include a support flange 80 along the length of the bottom edge thereof. The support flange 80 is sized for insertion into the wall channel 60 of the base 18. The shelf supports 22*a* and 22*c* are detachably connected relative to the side walls 16*a* and 16*c*.

The raised outer rim 66 of the cover 20 is formed of a U-shaped lip 82 defining a cavity 84 which is sized to extend over a top portion of the side walls 16 and enclose the top portion of the side walls 16 to secure the cover 20 relative to the container 10. The recessed central portion 67 is depressed from the raised outer rim 66 so that it forms the U-shaped lip 82 and the cover 20 extends between side walls 16*a*–*b* slightly within the inner cavity 14 of the container 10. The legs 58 about the perimeter of the base 18 are spaced from the outer edge of the perimeter of the container 10. The perimeter legs 58 are spaced a distance slightly greater than the width of the raised outer rim 66 so that the perimeter legs 58 extend into the recessed central portion 67 of the cover 20 when multiple containers 10 are stacked to reduce the height of the stacked containers. The center legs 58 of base 18 fit into corresponding leg recesses 69*a*, 69*b* and 69*c* of the cover 20.

Figure 3:
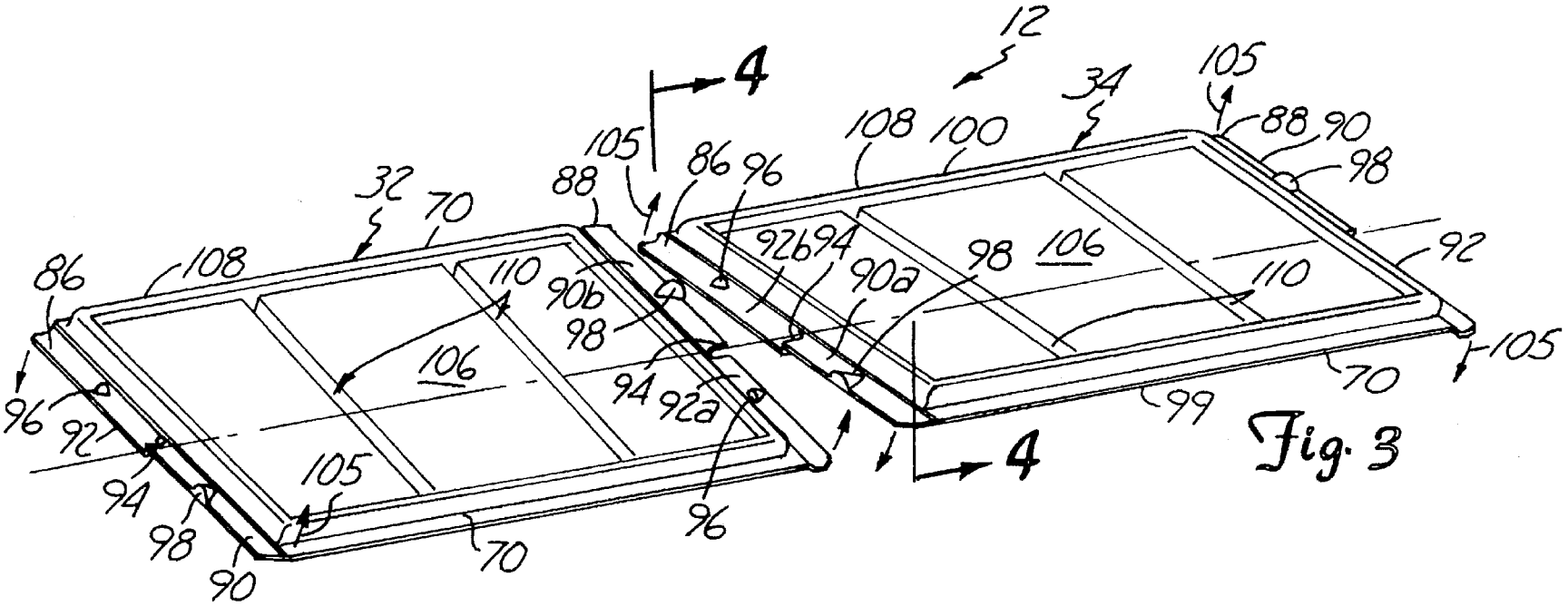
FIG. 3 is a perspective view of the removable shelves of the present invention.
Figure 4:
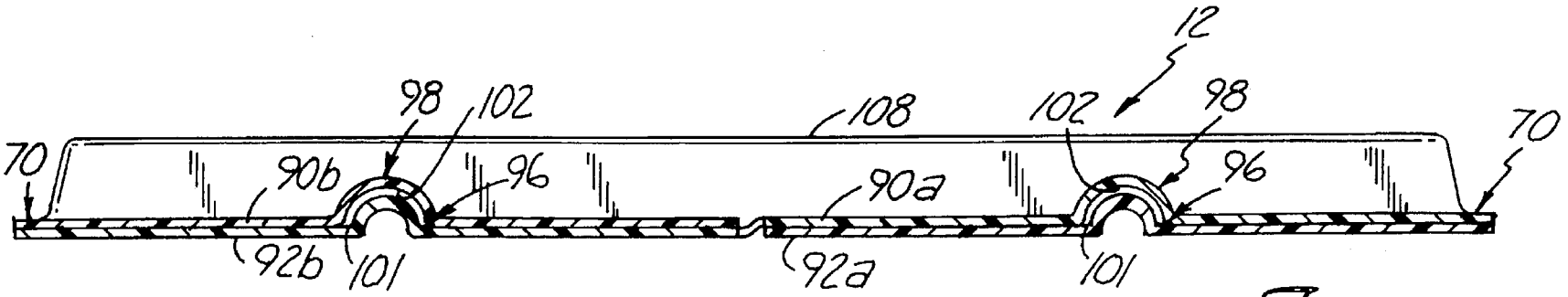
FIG. 4 is a cross sectional view of connected shelf interlocking portions taken generally along line 4—4 of FIG. 3.

FIGS. 3 & 4 illustrate the shelves 12 in more detail. As shown in FIGS. 3 & 4, the interlocking shelf portions 32 & 34 are connected together to form a shelf 12. The interlocking shelf portions 32 and 34 include opposed ends 86 and 88. The ends 86 and 88 of the interlocking shelf portions 32 & 34 include a raised ledge portion 90 and a lowered ledge portion 92, a coupling slot 94, a triangular shaped protrusion 96 and cone-shaped socket 98.

To connect the interlocking shelf portions 32 & 34 to form a shelf 12 that extends between side wall 16*b* and 16*d*, end 88 of interlocking shelf portion 32 is coupled with end 86 of interlocking shelf portion 34. The raised ledge portions 90 and lower ledge portions 92 of ends 86 and 88 are arranged so that the raised ledge portion 90 of end 86 cooperates with the lower ledge portion 92 of end 88 and the lower ledge portion 92 of end 86 cooperates with the raised ledge portion 90 of end 88. To explain in more detail, the raised ledge portion 90*a* of end 86 is on a first side 99 of the interlocking shelf portions 32 & 34 and mates with the lowered ledge portion 92*a* of end 88 on the first side 99. The lower ledge portion 92*b* is on a second side 100 of the interlocking shelf portions 32 & 34 and mates with the raised ledge portion 90*b* of end 88 on the second side 100 of the interlocking shelf portions 32 & 34.

The coupling slot 94 is formed between the offset raised ledge portion 90 and the lowered ledge portion 92 of ends 86 and 88 of the interlocking shelf portions 32 and 34. The coupling slot 94 extends the width of the raised and lower ledge portions 90 and 92 so that the raised and lower ledge portions 90 and 92 of end 88 of interlocking shelf portion 32 can mate as described with the raised and lower ledge portions 90 and 92 of end 86 of interlocking shelf portion 34.

The lower ledge portions 92 include the triangular shaped protrusions 96 extending from an upper mating surface. The cone shaped sockets 98 are formed in the raised ledge portions 90. As shown in FIG. 4, the cone shaped socket 98 includes a mouth 101 (on a lower surface of the raised ledge portion 90) opening into a cone-shaped socket cavity 102 at a lower surface of the raised ledge portion 90. The mouth 101 and cone-shaped socket cavity 102 are sized to accommodate the triangular-shaped protrusion 96 therein. The mated ends 88 and 86 of the interlocking shelf portions 32 & 34 are locked via cooperation of the triangular shaped protrusions 96 which fit into the cone-shaped socket cavities 102 as shown in FIG. 4.

To connect the ends 88 and 86 of the interlocking shelf portions 32 and 34, sides 99 and 100 are tilted as shown in FIG. 3 to offset the triangular shaped protrusions 96 from the corresponding cone shaped sockets 98 to fit the triangular-shaped protrusions 96 into the socket cavities 102. The interlocking shelf portions 32 and 34 are rotated to a perpendicular support position (as shown by arrows 105) to insert the protrusions 96 into the socket cavities 102 to lock the shelf portions 32 and 34 together as shown in FIG. 4.

The interlocking shelf portions 32 and 34 include an upper shelf surface 106, a raised outer ridge 108, and drain channels 110. Content is supported on the upper shelf surface 106. The raised ridge 108 is formed about the periphery of the upper shelf surface 106. The raised ridge 108 prevents liquid from draining from the shelf surface 106 into the inner cavity 14 of the container 10. Drain channels 110 are included to collect liquid which may drain from content away from the shelf surface 106. Preferably, the drain channels 110 extend crosswise between sides 99 and 100.

Figure 5:
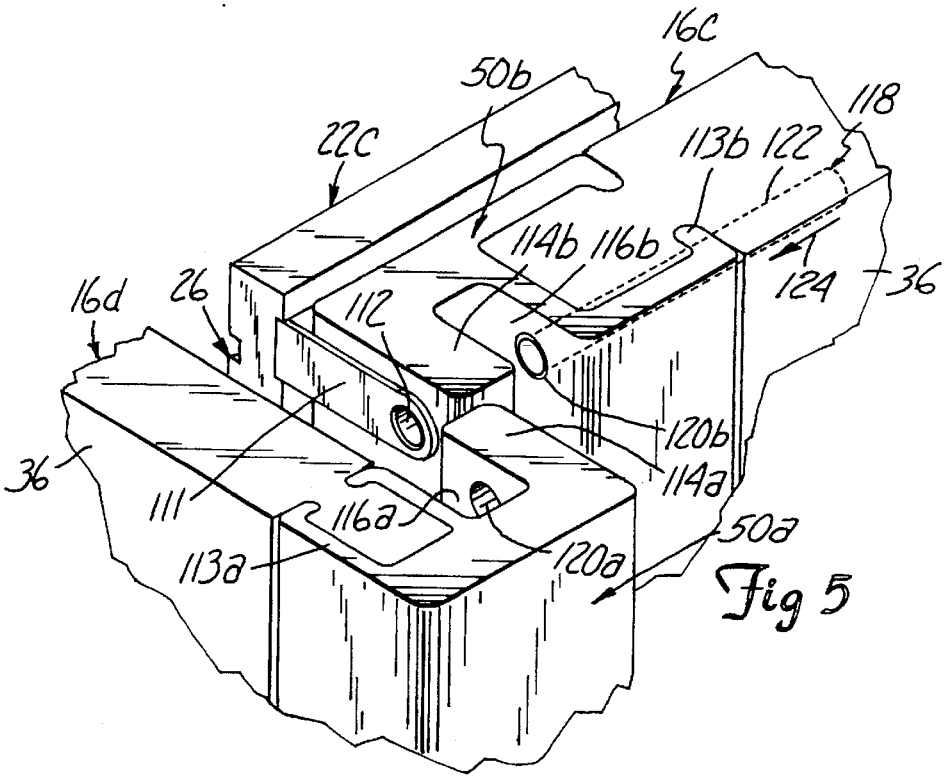
FIG. 5 is a detailed perspective view of corners of adjacent side walls of a container shown disconnected and coupling members for connecting adjacent side walls and shelf support.

The shelf supports 22*a* and 22*c* may be integrally formed with the side walls 16 of the container 10. Alternatively, as shown in FIG. 5, the shelf support 22*a* and 22*c* may be separately formed from side wall 16*a* and 16*c* and selectively coupled to the side walls 16*a* and 16*c* via cooperation of coupling members 50*a* and 50*b*. FIG. 5 illustrates connection of adjacent side walls 16*c* and 16*d* via coupling members 50*a* and 50*b*. As shown in FIG. 5, the shelf supports 22*a*' and 22*c*' include a bracket 111 which extends from an end of the shelf support 22*c*'. Bracket 111 includes a pin hole 112. Coupling members 50*a* and 50*b* are secured to the side wall 16*c* and 16*d* along the edges thereof by U-shaped attachments 113*a* and 113*b*.

As shown, the cooperating coupling members 50*a* and 50*b* include cooperating coupling extensions 114*a* and 114*b* and coupling channels 116*a* and 116*b*. To secure adjacent upper panels 36 of adjacent side walls 16*c* and 16*d*, the coupling extensions 114*a* and 114*b* are secured within coupling channels 116*a* and 116*b* of cooperating coupling members 50*a* and 50*b*. To disconnect adjacent upper panels 36 of side wails 16*c* and 16*d*, the coupling extensions 114*a* and 114*b* are detached from the coupling channels 116*a* and 116*b*. When adjacent upper panels 36 are disconnected, the upper panels 36 may be collapsed as shown by arrow 40 in FIG. 1.

The bracket 111 is inserted into coupling channel 116*a* with coupling extension 114*b* to secure the shelf support 22*c*' relative to the connected coupling members 50*a* and 50*b*. In particular, coupling extension 114*a* of coupling member 50*a* is inserted into coupling channel 116*b* of coupling member 50*b*. Conversely, coupling extension 114*b* of coupling member 50*b* (and bracket 111 of shelf support 22*c*') is inserted into coupling channel 116*a* of coupling member 50*a* to selectively connect and disconnect adjacent side walls 16*c* and 16*d* and shelf supports 22*c*'.

The coupling members 50*a* and 50*b* of side walls 16*c* and 16*d* are securely connected by a latch assembly 118. The coupling members 50*a* and 50*b* include through holes 120*a* and 120*b*. The latch assembly 118 includes a slidable pin 122 which moves between a latched position (not shown) and an opened position (shown) to selectively lock the connected side walls 16*c* and 16*d* and shelf support 22*c*'.

The through holes 120*a* and 120*b* extend cross-wise through the coupling channels 116*a* and 116*b* and coupling extensions 114*a* and 114*b* of the coupling members 50*a* and 50*b*. When the coupling members 50*a* and 50*b* are connected as previously described, the slidable pin 122 is moved into the locking position (not shown) by moving pin 122 in the direction of arrow 124 until the pin 122 extends through holes 116*a* and 116*b* of the coupling members 50*a* & 50*b* and pin hole 112 of bracket 111. In the latched position (not shown), the slidable pin 122 prevents the coupling members 50 and 50*b* and bracket 111 from disengaging to maintain the side walls 16*c* and 16*d* and shelf support 22*c*' connected. To release the shelf support 22*c*' and the connected side walls 16*c* and 16*d*, the slidable pin 122 is retracted as shown out of alignment with the through holes 116*a* and 116*b* and pin hole 112.

Figure 6:
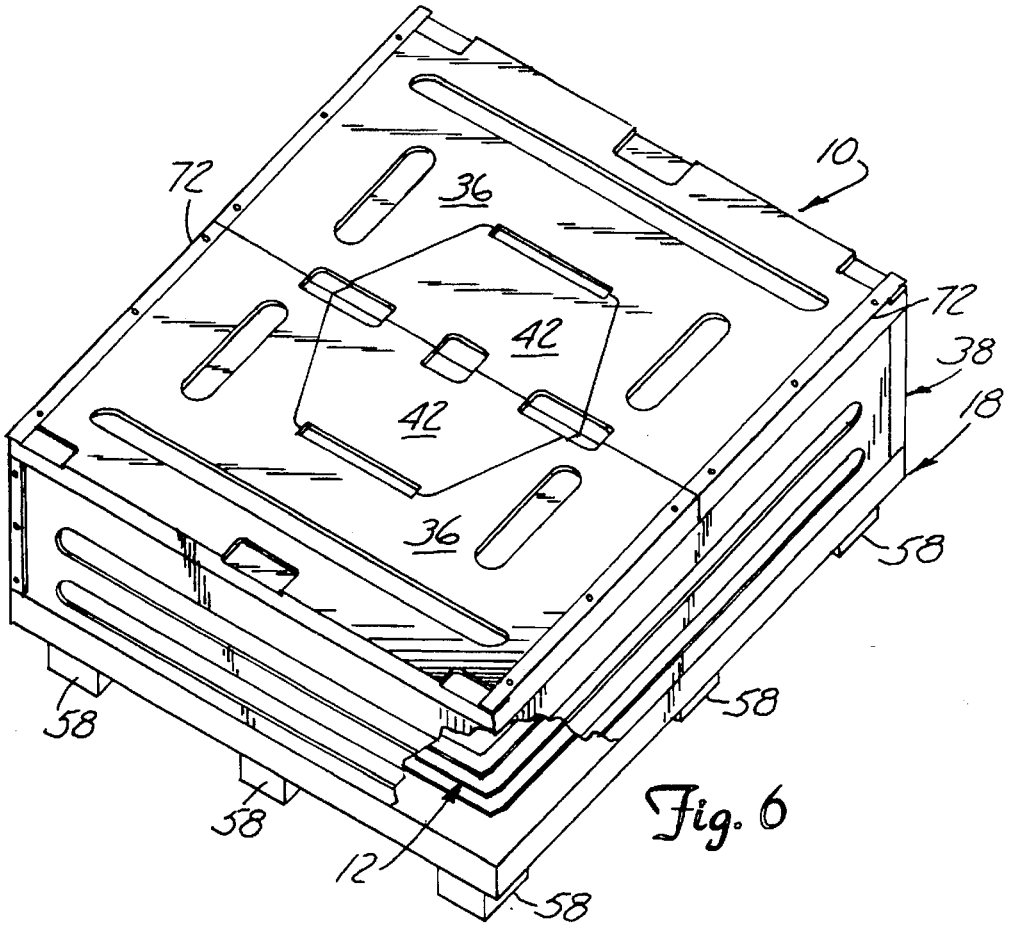
FIG. 6 is a perspective view of a collapsed container of the present invention.

When the coupling members 50*a* & 50*b* are disconnected as shown in FIG. 5, the upper panels 36 of the side walls 16, may be folded inwardly at hinge 72 to collapse the container 10 for storage as shown in FIG. 6. As shown in FIG. 6 (at the break away portion to the inner cavity 14 of the container 10) the shelves 12 may be slidably removed from the shelf supports 22*a*–22*c* and stored in inner cavity 14 of the collapsed container 10 with shelf support 22*b* as illustrated in FIG. 6. If detachable shelf supports 22*a* and 22*c* are employed they can be separated from the side wails 16 and also stored in the inner cavity 14 of the collapsed container 10.

Figure 7:
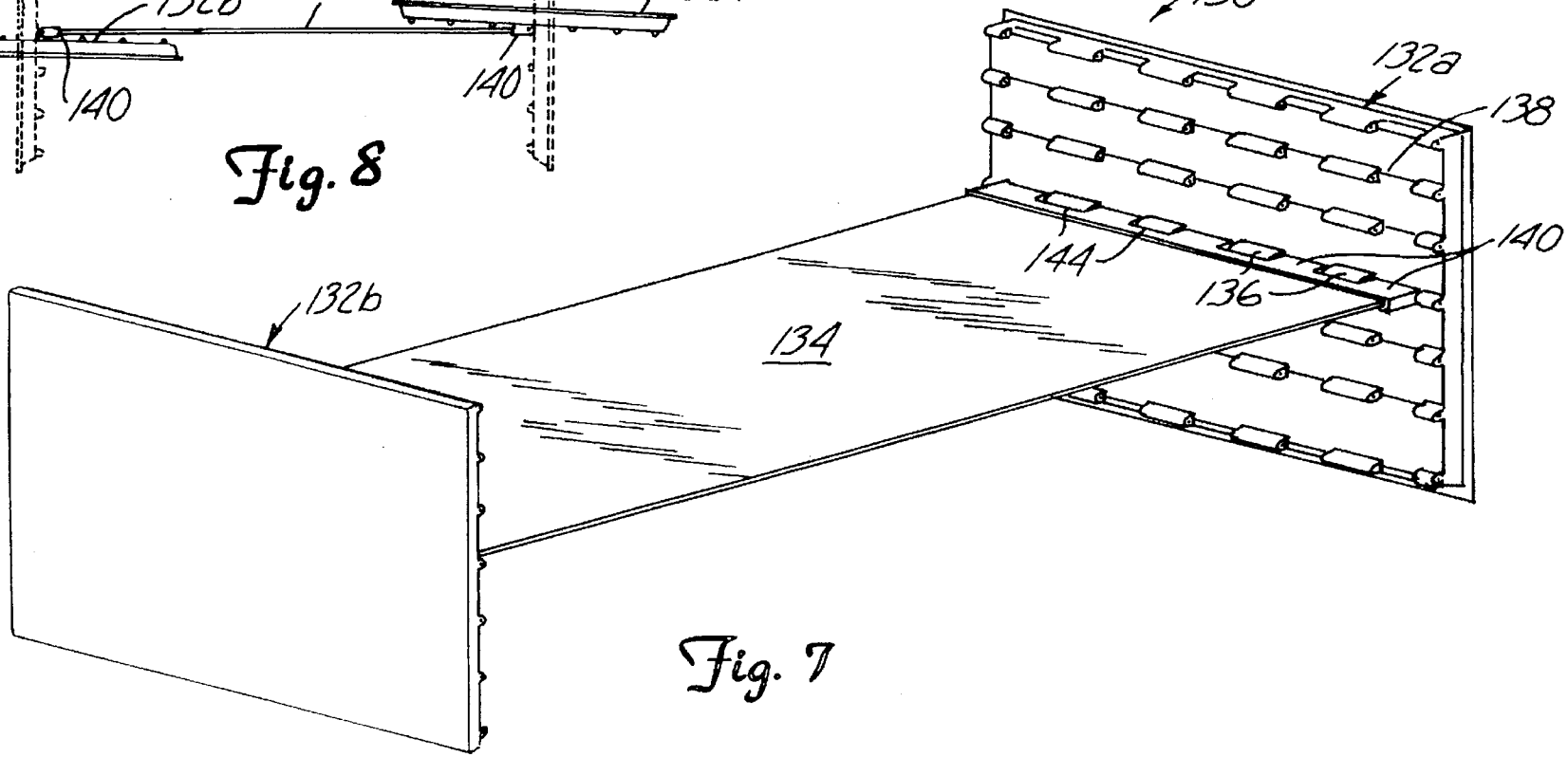
FIG. 7 is a perspective view of an alternate embodiment of a removable shelf system of the present invention.

FIG. 7 illustrates an alternate embodiment of a removable shelf system 130 of the present invention for use in a transport container 10 as shown in FIG. 1. The removable shelf system 130 of FIG. 7 is free standing and includes shelf supports 132*a* and 132*b* and shelf 134 which extends perpendicularly from the shelf supports 132*a* and 132*b* therebetween. The shelf is pivotally connected to each shelf support 132*a* and 132*b*. The shelf supports 132*a* and 132*b* include spaced hinge supports 136 having hinge bores 138 extending therethrough. Opposed sides of the shelf 134 include spaced shelf hinge supports 140, having a hinge bores (not shown) extending therethrough, and shelf hinge channels 144.

Figure 8:
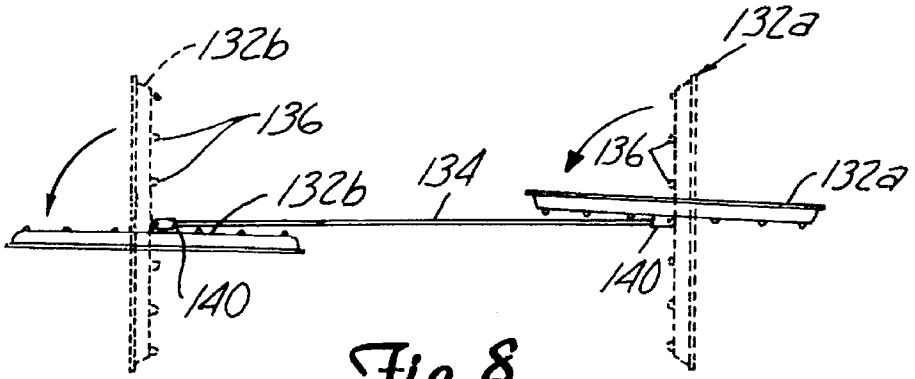
FIG. 8 is a perspective view of the shelf system of FIG. 7 shown collapsed.

The hinge supports 136 of shelf supports 132*a* and 132*b* extend into the shelf hinge channels 144 of the shelf 134 so that the hinge bores 138 of the hinge supports 136 align with the hinge bores (not shown) of the shelf hinge supports 140. A hinge pin (not shown) extends through the aligned hinge bores to pivotally connect the shelf 134 relative to the shelf supports 132*a* and 132*b* so that the shelf system 130 pivots between an operational position (shown in FIG. 7 and in phantom in FIG. 8) and a collapsed position as shown in FIG. 8. In the collapsed position, the shelf system 130 may be stored in the inner cavity 14 of the container 10. Rows of shelves 134 maybe hingedly connected relative to the shelf supports 132*a* and 132*b* for storing multiple layers of content.

Preferably, the container 10 and cover 20 may be formed of a blow molded polymer material such as a high density polyethylene. The shelves 12 and detached shelf supports 22 are formed of a thermoplastic material. The container may be thermally insulated and include a thermally insulated cover 20 for temperature sensitive applications. The side walls 16 and base 18 of the thermally insulated container are preferably formed of a hollow core and filled with a polyurethane foam or other insulating material. A thermally insulated inner cover may be used in association with cover 20 for temperature sensitive applications.

Although the present invention has been described with reference to preferred embodiments, workers skilled in the art will recognize that changes may be made in form and detail without departing from the spirit and scope of the invention.

What is claimed is:

1. A removable shelf system for a transport container comprising:

a plurality of shelves;

opposed shelf supports;

means for supporting the shelf supports in an upright position within an inner cavity of the container; and means for removably supporting the shelves relative to the shelf supports, wherein the shelves are formed of first and second interlocking shelf portions having opposed ends which opposed ends include offset raised ledge portions and lowered ledge portions, the raised ledge portions including a protrusion and the lowered ledge portions including a socket, the lowered ledge portion of an end of the first interlocking shelf portion being aligned with the raised ledge portion of an adjacent end of the second interlocking portion for insertion of the protrusion into the socket and the raised ledge portion of the first interlocking shelf portion being aligned with the lowered ledge portion of the second interlocking shelf portion for insertion of the protrusion into the socket to connect adjacent ends of the first and second interlocking shelf portions.

2. The removable shelf system of claim 1 wherein the shelf supports are removably supported relative to the side wall of a transport container.

3. The removable shelf system of claim 1 including shelf supports at side walls of the container and a shelf support positioned therebetween in an inner cavity of the container.

4. The removable shelf system of claim 1 wherein the shelf supports are removably supported within the inner cavity of a container.

5. The removable shelf system of claim 1 wherein the shelf supports include grooves and opposed sides of the shelves include lips, the lips being sized relative to the grooves for insertion therein to removably support the shelves relative to the shelf supports.

6. The removable shelf system of claim 1, wherein the opposed shelf supports are integrally formed with side walls of the transport container.

7. The removable shelf system of claim 1 wherein in the shelves include drain channels.

8. The removable shelf system of claim 1 wherein the protrusion and socket are triangular shaped.

9. The removable shelf system of claim 1 wherein the shelf supports are formed of a thermally resistive material.

10. The removable shelf system of claim 1 wherein the shelves include a raised outer ridge about a perimeter of a shelf surface.

11. In combination:

a pallet sized transport container having perpendicularly aligned side walls extending from a base to form an inner cavity for storing content, the side walls being formed of upper and lower panels hingedly connected and including cooperating coupling members for selectively connecting and disconnecting adjacent upper panels, the coupling members being attached along upright edges of adjacent .side walls, said coupling members including coupling channels and coupling extensions, the coupling extensions of a first coupling member being insertable into the coupling channel of a second adjacent coupling member and the coupling extension of the second adjacent coupling member being insertable into the coupling channel of the first coupling member to selectively connect and disconnect adjacent side walls;

a plurality of shelves;

opposed shelf supports;

means for supporting the shelf support in an upright position within an inner cavity of the transport container; and means for removably supporting the shelves relative to the shelf supports.

12. The combination of claim 11 wherein the shelves are formed of first and second shelf portions which interlock.

13. The combination of claim 12 wherein the shelves have opposed ends which include offset raised ledge portions and lowered ledge portions, the lowered ledge portion of an end of the first shelf portion being aligned with the raised ledge portion of an adjacent end of the second shelf portion and the raised ledge portion of the first shelf portion being aligned with the lowered ledge portion of the second shelf portion to interlock the first and second shelf portions.

14. The combination of claim 13 wherein the opposed shelf supports are integrally formed with the side walls of the container.

15. The combination of claim 11 wherein at least one side wall of the transport container is removably supported relative to the base and adjacent side walls for access to the shelves in the inner cavity of the container.

16. The combination of claim 11 wherein the shelf supports are removably supported relative to the side walls.

17. The combination of claim 11 wherein at least one shelf support is positioned centrally in the inner cavity of the transport container.

18. The combination of claim 11 wherein the means for supporting the shelf supports in an upright position within an inner cavity of the transport container comprises:

a bracket extending from the shelf support, said bracket being insertable into the coupling channel of a coupling member to secure the shelf support relative to connected side walls.

19. The combination of claim 18 wherein the bracket includes a through hole and the coupling members include a through hole and further including:

a latch assembly including a slidable pin which moves between a latched position and an unlatched position, in the latched position, the pin extending through the through holes of the coupling members and bracket and in the unlatched position, the pin being removed from the through holes to allow the shelf support to be removed and the container collapsed.

20. The combination of claim 11 including a cover having first and second portions hingedly connected to provide selective access to the inner cavity of the container.

* * * * *

UNITED STATES PATENT AND TRADEMARK OFFICE

CERTIFICATE OF CORRECTION

PATENT NO. : 5,642,923

DATED : JULY 1, 1997

INVENTOR(S) : PATRICK E. MEACHAM, MARK W. WALLACE, CARL R. NYBERG, WILLIAM W. THOMPSON, JAMES P. BLAND

It is certified that error appears in the above-indentified patent and that said Letters Patent is hereby corrected as shown below:

Col. 2, line 39, delete "comer", insert --corner--

Col. 2, line 40, delete "comer", insert --corner--

Col. 2, line 50, after "described.", delete "."

Col. 5, line 43, delete "wails", insert --walls--

Signed and Sealed this

Eleventh Day of November, 1997

*Attest:*

*Attesting Officer*

Bruce Lehman

BRUCE LEHMAN

*Commissioner of Patents and Trademarks*